US005523740A

United States Patent [19]

Burgmann

[11] Patent Number: 5,523,740

[45] Date of Patent: Jun. 4, 1996

[54] WEARABLE TRANSMITTER ASSEMBLY

[75] Inventor: Thomas A. Burgmann, Mississauga, Canada

[73] Assignee: Detection Systems, Inc., Fairport, N.Y.

[21] Appl. No.: 427,550

[22] Filed: Apr. 24, 1995

[51] Int. Cl.[6] ..... G08B 13/186

[52] U.S. Cl. ..... 340/573; 340/539; 340/693; 379/38; 455/100

[58] Field of Search ..... 340/573, 539, 340/693; 379/38; 455/100

[56] References Cited

U.S. PATENT DOCUMENTS

| | | | |
|---|---|---|---|
| 4,546,345 | 10/1985 | Naito | 340/542 |
| 4,812,823 | 3/1989 | Dickerson | 340/572 |
| 4,885,571 | 12/1989 | Pauley et al. | 340/573 |
| 5,014,040 | 5/1991 | Weaver et al. | 340/572 |
| 5,298,884 | 3/1994 | Gilmore et al. | 340/573 |
| 5,374,921 | 12/1994 | Martin et al. | 340/539 |
| 5,471,197 | 11/1995 | McCurdy et al. | 340/573 |

*Primary Examiner*—Glen Swann
*Attorney, Agent, or Firm*—J. Addison Mathews

[57] ABSTRACT

A transmitter assembly is characterized by a buckle including fasteners for holding a strap and the buckle together on an appendage of an individual independent of a transmitter. The buckle also includes latches for attaching the transmitter to the buckle after the buckle is strapped to the individual. An optical fiber running through the strap is held by the fasteners with the ends of the fiber in predetermined positions relative to the buckle. The transmitter covers the strap fasteners, rendering the fasteners inaccessible to the individual, and aligns an emitter and sensor on the transmitter housing with the ends of the optical fiber in the predetermined positions. The ends of the strap are aligned adjacent one another by the buckle, so the buckle adds little to the length of the strap, permitting length measurements without considering the buckle contribution.

25 Claims, 6 Drawing Sheets

WEARABLE TRANSMITTER ASSEMBLY

BACKGROUND OF THE INVENTION

1. Field of Invention

The invention relates to wearable transmitter assemblies for monitoring individuals and more specifically to such an assembly secured with a strap to an appendage of the individual. The invention has particular utility with transmitters in "house arrest" systems including tamper detection features coupled through the strap.

2. Description of the Prior Art

Personal monitoring systems are known to include a wearable transmitter, sometimes called a tag or beacon, that communicates with a field station linked to a monitoring center. In house arrest systems, for example, the presence or absence of an individual is monitored to determine when the individual leaves and returns to a predetermined location, frequently a home. A transmitter on the individual broadcasts a radio frequency signal at relatively low power. A corresponding field station in the home includes a receiver for detecting the signal whenever the transmitter is within range. If the monitored individual leaves the home, the distance from the transmitter to the field station exceeds the range of the system and it loses the signal. Unscheduled signal losses initiate a reporting sequence including notification of an infraction sent to the monitoring center.

The transmitter usually is secured with a strap selected to fit comfortably but snugly around a wrist or ankle of the individual so the transmitter cannot be removed. Tamper circuits in the transmitter housing detect any cutting or removal of the strap that might be associated with unauthorized removal of the transmitter. Tamper information is transmitted to the home receiver and forwarded to the monitoring center. If the transmitter is not within range of the system when the tamper occurs, the tamper signal is stored and transmitted later when communication with the system is reestablished.

PROBLEM SOLVED BY THE INVENTION

Existing transmitter assemblies can be difficult to fit on the wrists or ankles of individuals ranging in size from very small wrists to very large ankles. Fit is important for comfort without the possibility of removal.

If the straps are manufactured to size, inventories must include a reasonable range of sizes at each location where straps are selected for fitting. Aggravating delays will result when required sizes are not in the local inventory. Straps can be cut to length at the scene of the fitting, but the transmitter housing adds to the length of the strap, and must be accounted for when the length is determined. Measuring can be imprecise or difficult when there are two contributing parts, the strap and the housing, particularly if the housing has an inconvenient shape or point of connection. Of course the strap also might have two sections that overlap for adjusting length, but this approach is more difficult to make tamper proof and to provide tamper detection.

Even when the strap is properly sized, coupling the strap to the transmitter is cumbersome in many existing systems, especially those that include a tamper detection circuit operating through the strap. If the strap signal is electrical, good connections are important to prevent corrosion and exclude foreign matter. If an optical fiber is used, the fiber ends must be clean and aligned for good light transmission. Convenient fitting of the transmitter assembly on the individual often is overlooked when designing for these other important factors.

SUMMARY OF THE INVENTION

The present invention is directed to overcoming one or more of the problems set forth above while providing further advantages in wearable transmitter assemblies. Briefly summarized, according to one aspect of the invention, a transmitter assembly is characterized by a buckle including fasteners for holding the strap and buckle together on an appendage of an individual independent of the transmitter. The buckle also includes latches for attaching the transmitter to the buckle after the buckle is strapped to the individual. According to more specific features, an optical fiber running through the strap is held by the fasteners with the ends of the fiber in predetermined positions relative to the buckle. The transmitter covers the strap fasteners, rendering the fasteners inaccessible to the individual, and aligns an emitter and sensor on the transmitter housing with the ends of the optical fiber in the predetermined positions. Still more specifically, the ends of the strap are aligned adjacent one another by the buckle, so the buckle adds little to the length of the strap, permitting length measurements without considering the buckle contribution.

According to other aspects of the invention, the transmitter housing contains a tamper detection circuit including a light emitter and a light sensor supported by the housing. The strap includes an imbedded optical fiber. The buckle supports the optical fiber, the emitter and the sensor to form a light path from the emitter through the fiber to the sensor. This light path will be broken, triggering a tamper signal, by any of the following events: a) separation of the housing from the buckle, b) separation of the strap from the buckle, or c) severing the strap.

The buckle also is defined as a wearable clip for attaching a transmitter to a body appendage with an elongate strap. The clip is a thin frame defining a first smooth side adapted to engage the appendage and a second opposite side including features for coupling the strap around the appendage to the clip. The second side also includes elements for receiving the transmitter on the frame with the transmitter capturing the strap against the frame, preventing release of the strap from the frame. The frame supports a flexible seal defining an inside region and an outside region, and the strap attaching features align the strap adjacent the seal at the outside region with the optical fiber extending through the seal to the inside region. The transmitter is located on the frame with the emitter and sensor adjacent the optical fiber at the inside region.

The invention includes methods for attaching a wearable transmitter to a body appendage including the steps of encircling the appendage with the strap and cutting the strap to a length snugly fitting around the appendage with no overlap between the ends of the strap; attaching the strap around the appendage with a buckle that locates the ends of the strap adjacent one another with said buckle and strap fitting snugly around said appendage; and attaching a transmitter to the buckle. Still more specifically, the strap is supplied in, and cut from, a bulk roll.

According to the inventive features, a strap can be measured for cutting by simply wrapping it around wrist or ankle of an individual and cutting the strap for a comfortable but snug fit with no overlap. Since the buckle adds only a very small amount to the strap length, its contribution can be ignored. The strap is then fastened around the wrist or ankle with fasteners that hold the strap and buckle together independently of the transmitter housing. The buckle and strap are light, do not include the transmitter or its battery, and are easily positioned on the monitored individual. The transmitter housing is then snapped in place on the buckle.

These and other features and advantages of the invention will be more clearly understood and appreciated from a review of the following detailed description of the preferred embodiments and appended claims, and by reference to the accompanying drawings.

DESCRIPTION OF THE PREFERRED EMBODIMENTS

House Arrest System

Figure 1:
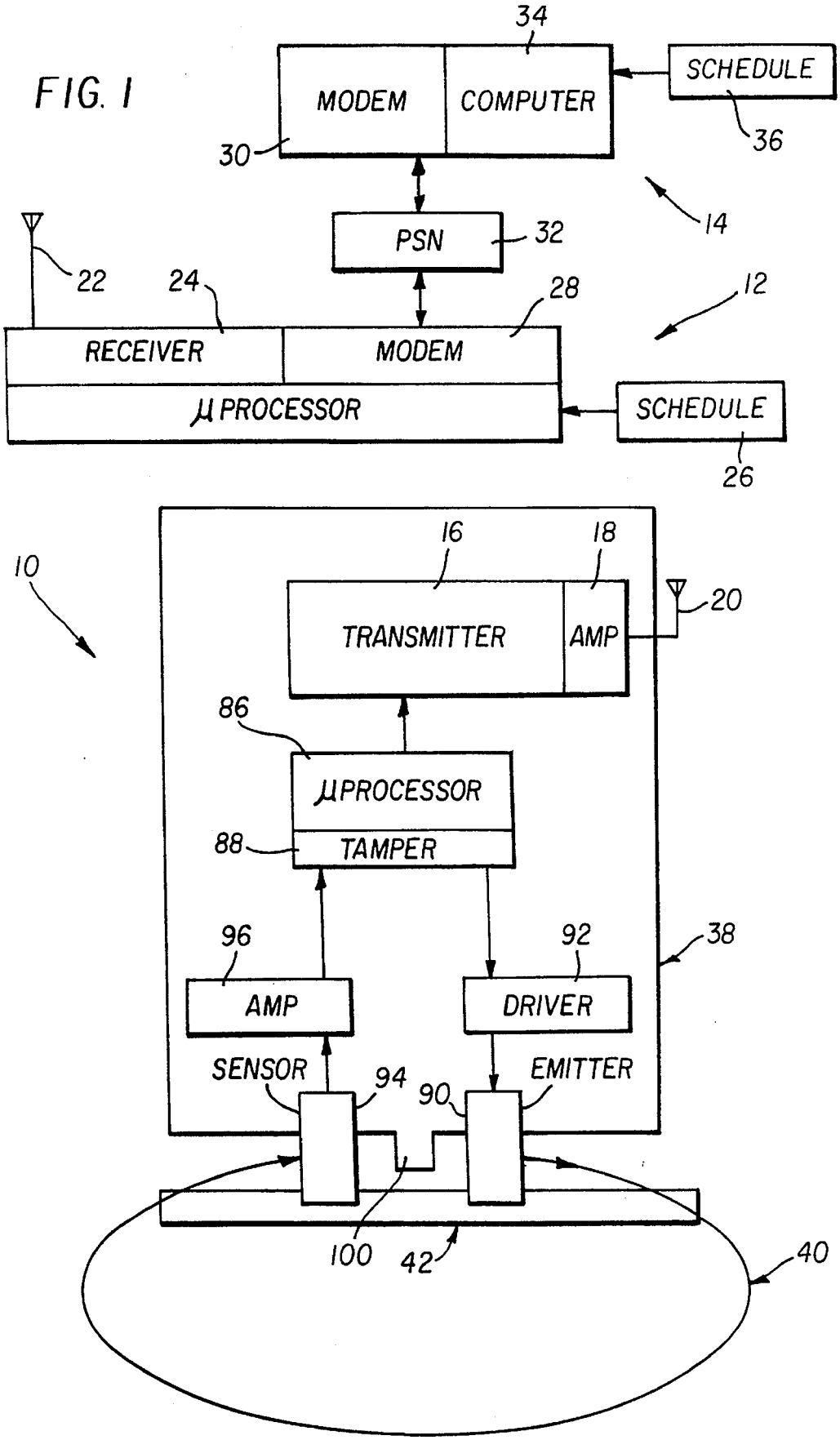
FIG. 1 is a schematic view of a personal monitoring system incorporating a preferred embodiment of the invention, including a wearable transmitter assembly, a field station for receiving signals from the transmitter assembly, and a monitoring center for communicating with the field station.

A house arrest system including a preferred embodiment of the invention is depicted in FIG. 1. The system includes a transmitter assembly 10, home or field station 12 and monitoring center 14. The transmitter assembly 10 is designed for wearing on an appendage, such as a wrist or ankle, of an individual and includes a transmitter 16, amplifier 18 and antenna 20 for transmitting a relatively weak radio frequency signal including a transmitter identification. The field station includes an antenna 22 and receiver 24 that monitors an area surrounding the receiver for detecting the transmitter signal. The range of the system is selected to cover a home, for example, so the signal is detected when the individual is home and lost beyond the range of the system when the individual leaves home. The field station also includes memory for storing an approved schedule 26, listing any times when the individual is expected to leave home and return home. If there is an unscheduled loss of the transmitter signal, the field station 12 calls the monitoring center 14 and reports the infraction. In this preferred embodiment, communications between the field station and monitoring center are through modems 28 and 30 and the public switching or phone network 32. Of course radio transmissions or cellular phone service also might be used. The monitoring center includes a computer 34 with a monitor and master schedule 36. It also stores information about the monitored individual, personnel to be notified in case an infraction occurs and an outline of appropriate steps to be taken for different catagories of infractions.

Transmitter Assembly

Figure 8:
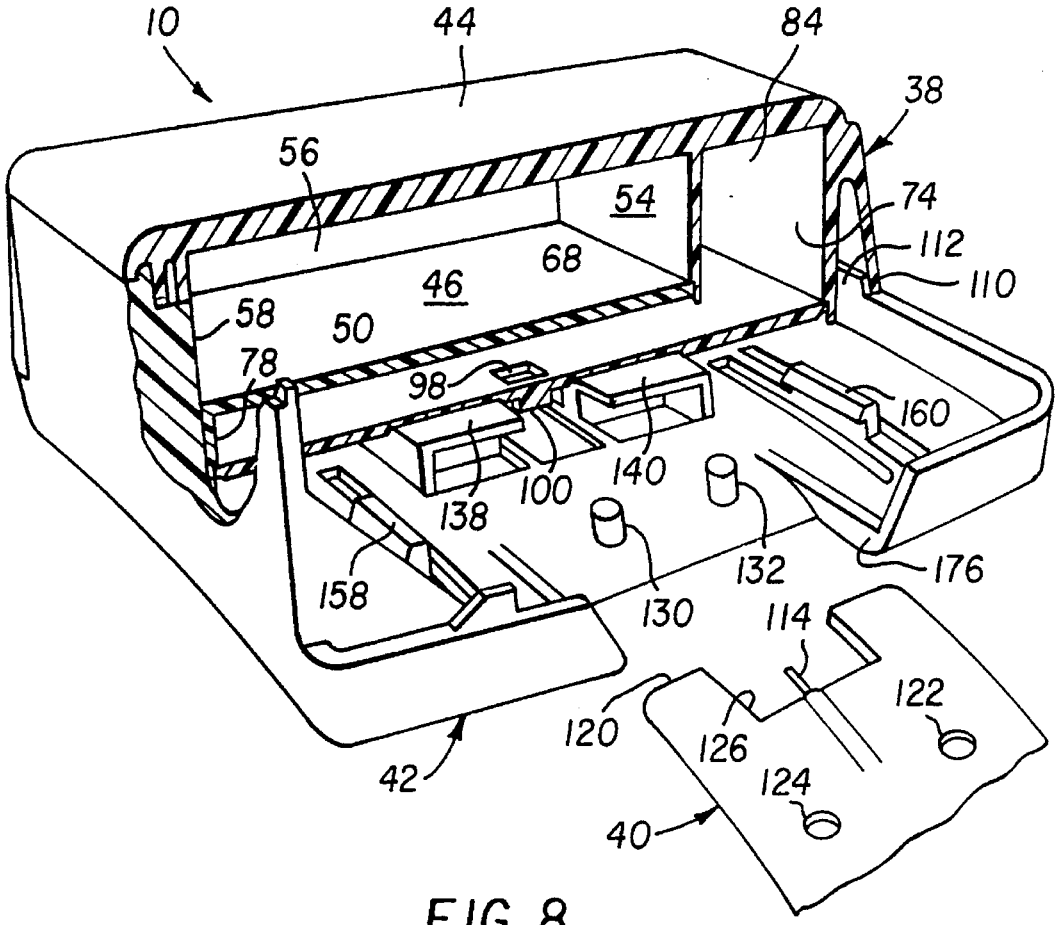
FIG. 8 is a partial perspective view of the wearable transmitter assembly with parts broken away to depict features of the strap, the buckle and the transmitter housing, according to the preferred embodiment.
Figure 9:
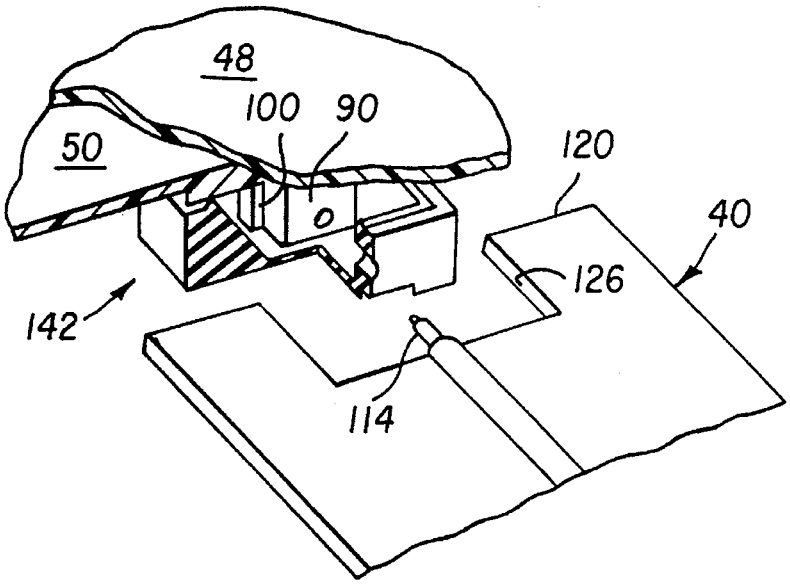
FIGS. 9 and 10 are partial views depicting details of the strap and its relationship to the buckle and tamper detection features supported by the transmitter housing.
Figure 10:
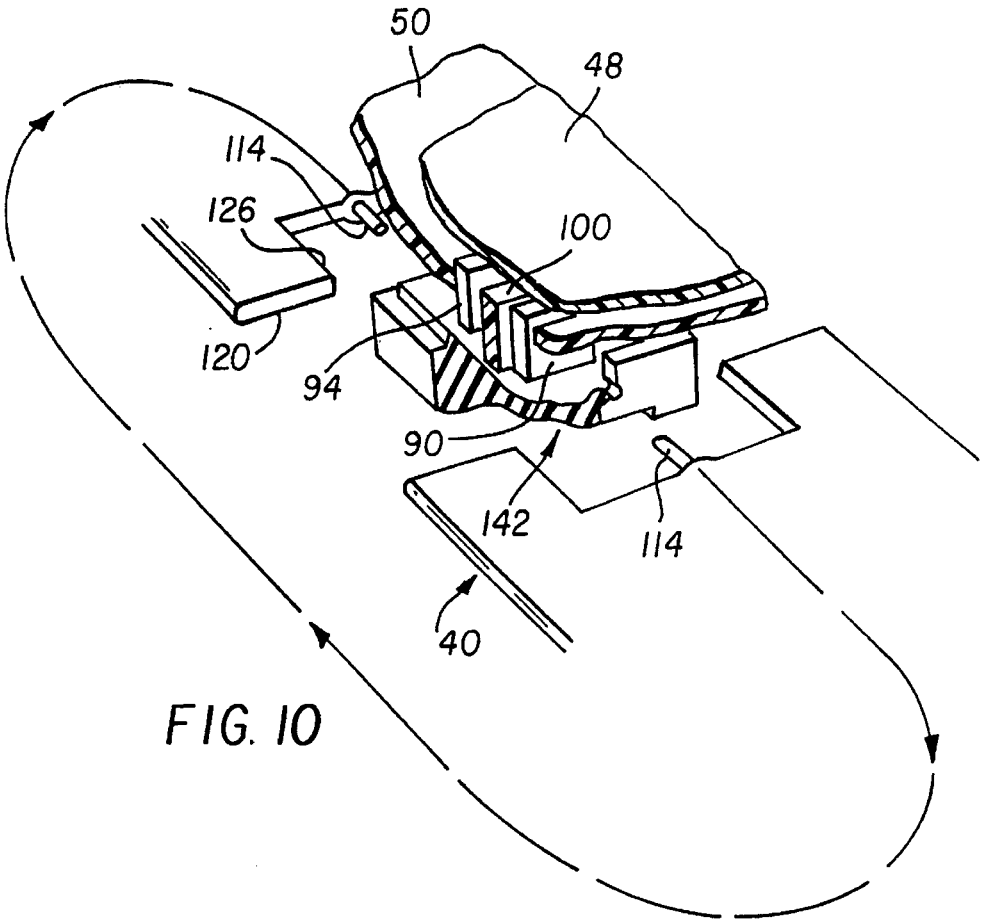

The transmitter assembly 10 (FIG. 8) includes transmitter housing 38, strap 40 and buckle 42, also called a clip.

Transmitter Housing

Figure 2:
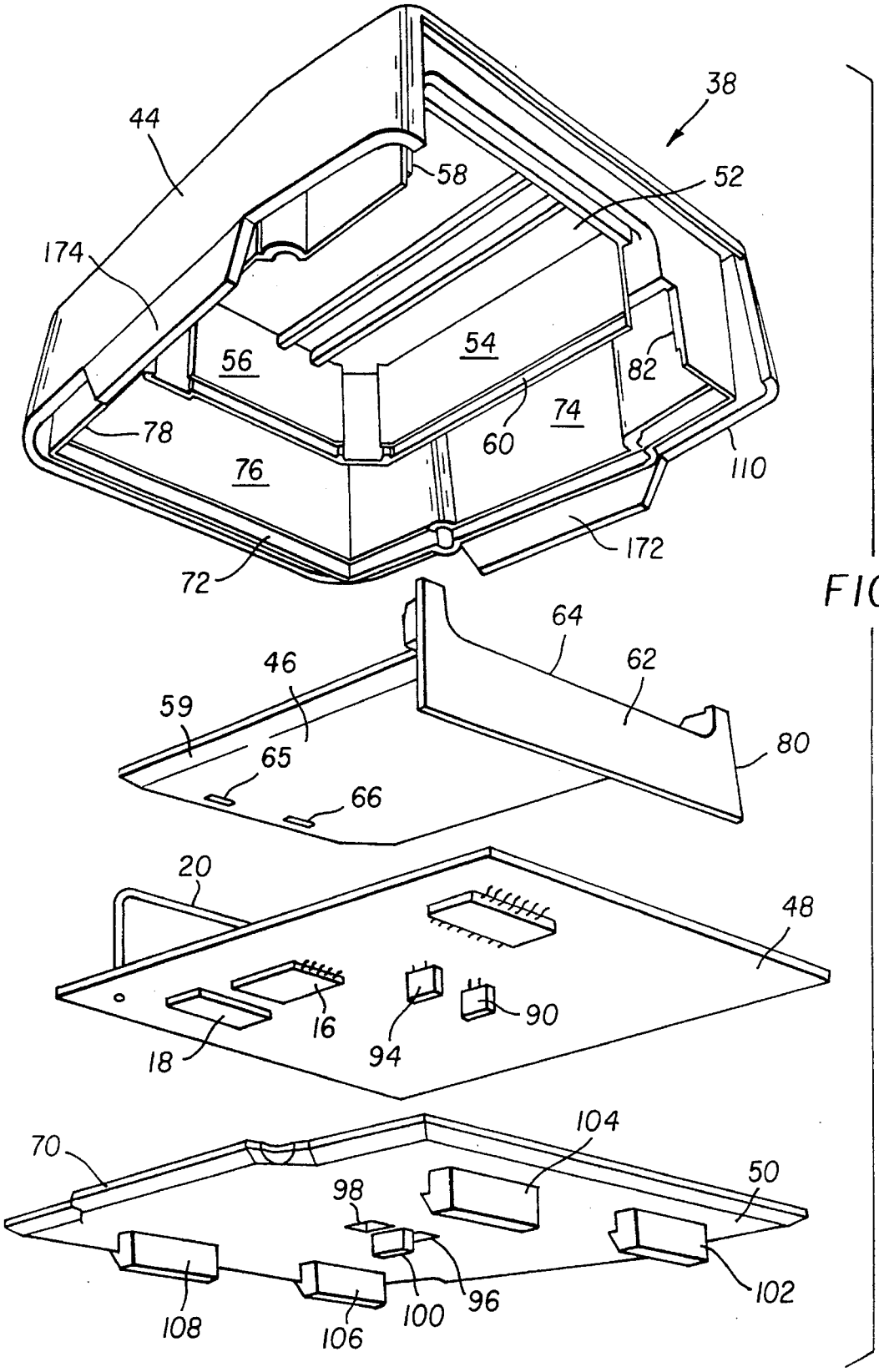
FIG. 2 is an exploded view of the transmitter housing.

The transmitter housing 38 is depicted most clearly in FIG. 2, including a housing cover 44, a battery shield 46, a circuit board 48 and a base plate 50. Housing 38 is adapted to enclose a battery pack (not shown), and the circuit board 48, in a sealed casing that will protect the battery and board from hostile environments including water immersion. The battery is received in a compartment 52 defined between the battery shield 46 and walls 54, 56, and 58, forming an enclosure within housing cover 44. The battery shield 46 is sealed in place during manufacturing with the peripheral edges 59 of the shield received in a recess 60 that extends around the top edges of walls 54, 56 and 58. The end of battery shield 46 includes a perpendicular face plate 62 defining with the housing cover an oval almost rectangular opening 64 that permits battery loading and replacement. The battery pack is moved endwise through opening 64 and into compartment 52, until contacts on the end of the battery pack electrically engage corresponding contacts 65 and 66, extending from the circuit board 48 through shield 46. The battery compartment is then sealed closed by a portion of the buckle 42, as will be described hereinafter.

Circuit board 48 is enclosed in another protected section 68 (FIG. 8) inside the housing cover 44 between the battery shield 46 and base plate 50. Base plate 50 defines peripheral edges 70 (FIG. 2) that are sealed in a recess 72 extending around the top edges of housing walls 74, 76 and 78. The peripheral edges 80 of face plate 62 similarly are sealed to housing wall 82, enclosing and protecting the circuit board 48. Antenna 20 extends away from the circuit board into an enlarged section or hallway 84 (FIG. 8) between wall 54 of the battery compartment and wall 74 of the transmitter housing.

The circuit board 48 carries a number of items shown most clearly in FIGS. 1 and 2. Already mentioned are the transmitter 16, amplifier 18 and antenna 20. Other items on the board include a microprocessor 86, tamper detection logic or circuits 88, a light emitter 90 and its driver 92, and a light sensor 94 and amplifier 96. Emitter 90 preferably is a light emitting diode (LED) with a side looking window and associated optics focusing light at right angles to the diode or parallel to the circuit board. When energized by driver 92, the diode emits light at predetermined wavelengths preferably in the visible region of the spectrum, preferrably around 660 nanometers. Of course infrared and other wavelengths also could be used. Sensor 94 is a photodetector sensitive to the same wavelengths generated by the emitter 96, and preferably is a PIN photodiode detector with a side looking window and associated optics. The microprocessor 86 and tamper circuits 88 drive the emitter 90 to pulse on for predetermined intervals preferably having a duration of fifty to one hundred microseconds (50–100 μs) every one second. The microprocessor 86 and tamper circuits 88 also check the signal from sensor 94 during at least the same intervals, looking for input signals at amplifier 96 that match the emitter output signals.

The emitter 90 and sensor 94 are suspended from the circuit board 48 in back-to-back relation, with the side looking window and associated optics pointing away from each other. The emitter 90 and sensor 94 are spaced apart slightly, and extend from adjacent the circuit board 48 through first and second apertures 96 and 98 in the base plate 50 to predetermined oppositely looking positions below the base plate. Appropriate pliant material is provided at the apertures 96 and 98 to seal any space between the base plate 50, the emitter 90 and sensor 94. A separator 100 extends from the base plate 50 between the apertures 96 and 98 to help support the emitter 90 and sensor 94 and to block stray light from passing directly to the sensor from the emitter.

Also extending from the bottom of the base plate 50, are latches 102, 104, 106, and 108, for attaching the transmitter assembly to the buckle. The latches apply a resilient force pulling the transmitter housing 44 and buckle 42 together, while an outer edge 110 on the housing mates with a lip 112 (FIG. 8) on the buckle to align and position one relative to the other, as will be described more fully hereinafter.

The transmitter housing described above is assembled and sealed during manufacture to produce a unitary assembly closed to the environment. While the battery compartment is open at one end for loading and removing the battery, the battery shield isolates the battery compartment from the sections of the housing that contain the circuit board.

Strap

Figure 3:
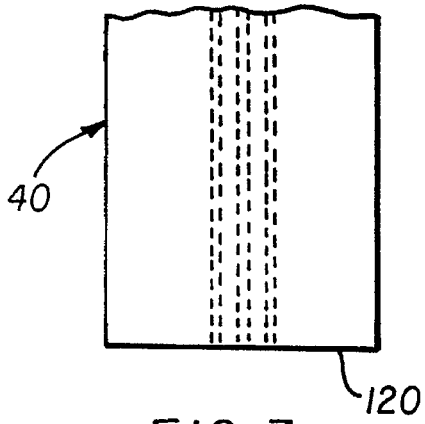
FIG. 3 is a partial top view of a strap for securing the transmitter assembly of FIG. 1 to an appendage according to the preferred embodiment.
Figure 4:
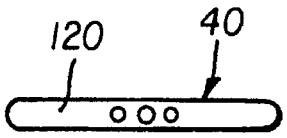
FIG. 4 is an end view of the strap depicted in FIG. 3.
Figure 5:
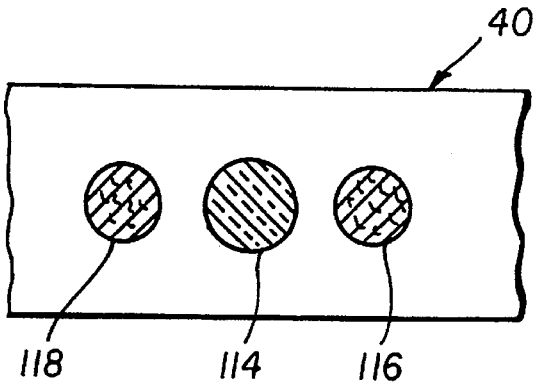
FIG. 5 is an enlarged partial end view of the strap of FIG. 3 depicting optical and non-stretch fibers embedded in the strap.
Figure 6:
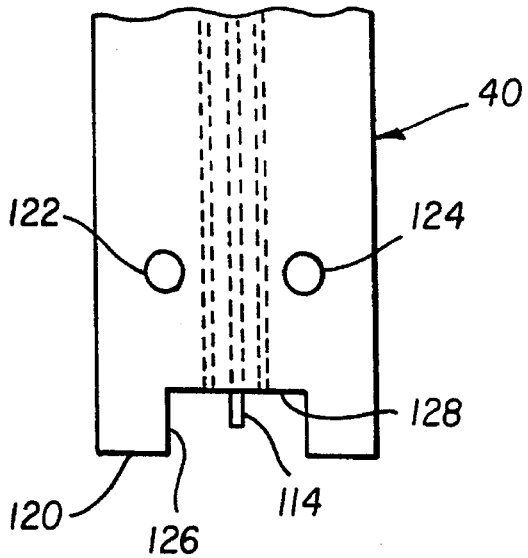
FIG. 6 is a top end view of the strap of FIG. 3, depicting a notch for mating with other components of the transmitter assembly.

Strap 40 is illustrated most clearly in FIGS. 3–6. FIGS. 3–5 show the strap as a continuous, one piece band that is manufactured and rolled into a bulk supply of fifty to one hundred feet. FIG. 6 depicts the strap after it is cut and the ends trimmed for attachment to the buckle 42.

Although many materials and configurations might be appropriate for the strap 50, the preferred embodiment is a flexible plastic material such as a polyester elastomer sold under the name Dupont Hytrel approximately one inch wide and one tenth of an inch thick. The width preferably is between half an inch and two inches wide, and the thickness preferably is less than a quarter of an inch thick. Three fibers are embedded in the strap running the entire length of the strap. One fiber, in the center of the strap, is an optical fiber 114 having a diameter less than the thickness of the strap. The other two fibers 116 and 118 are a thermally inelastic and non-stretchable material, such as a fiber sold under the name Dupont Kevlar, spaced on opposite sides of the optical fiber. Other non-streatchable materials might include wires or glass strands. Although the strap material is not easily stretched, it is thermoplastic, and the addition of the thermally inelastic strands add security against stretching under aggravated conditions that might include heat.

When the strap is used for mounting a transmitter assembly on an appendage of an individual, it is pulled from the bulk supply and cut to length. The length is measured by encircling the appendage so it fits comfortably, but snugly, with no overlap, and cutting the strap from the supply to form opposite ends 120. This provides a strap length slightly larger than the outer dimensions or circumference of the appendage.

After the strap is cut to length, holes 122 and 124 are formed, preferably by punching, approximately half of an inch, or slightly more, from the end 120 and approximately one quarter of an inch on each side of the optical fiber. A recess or notch 126 also is removed from the end of the strap, defining bifurcated end sections extending on opposite sides of the notch and revealing or exposing the end of the optical fiber 114, which extends into the notches laterally between the bifurcated extensions. The notch is approximately one half of an inch wide and one eighth of an inch deep. The optical fiber 114 is shortened slightly, but still extends beyond the end 128 of notch 126.

When the strap is used to secure a transmitter to an individual, the optical fiber will transmit light signals through the band from one end to the other.

Buckle or Clip

Figure 7:
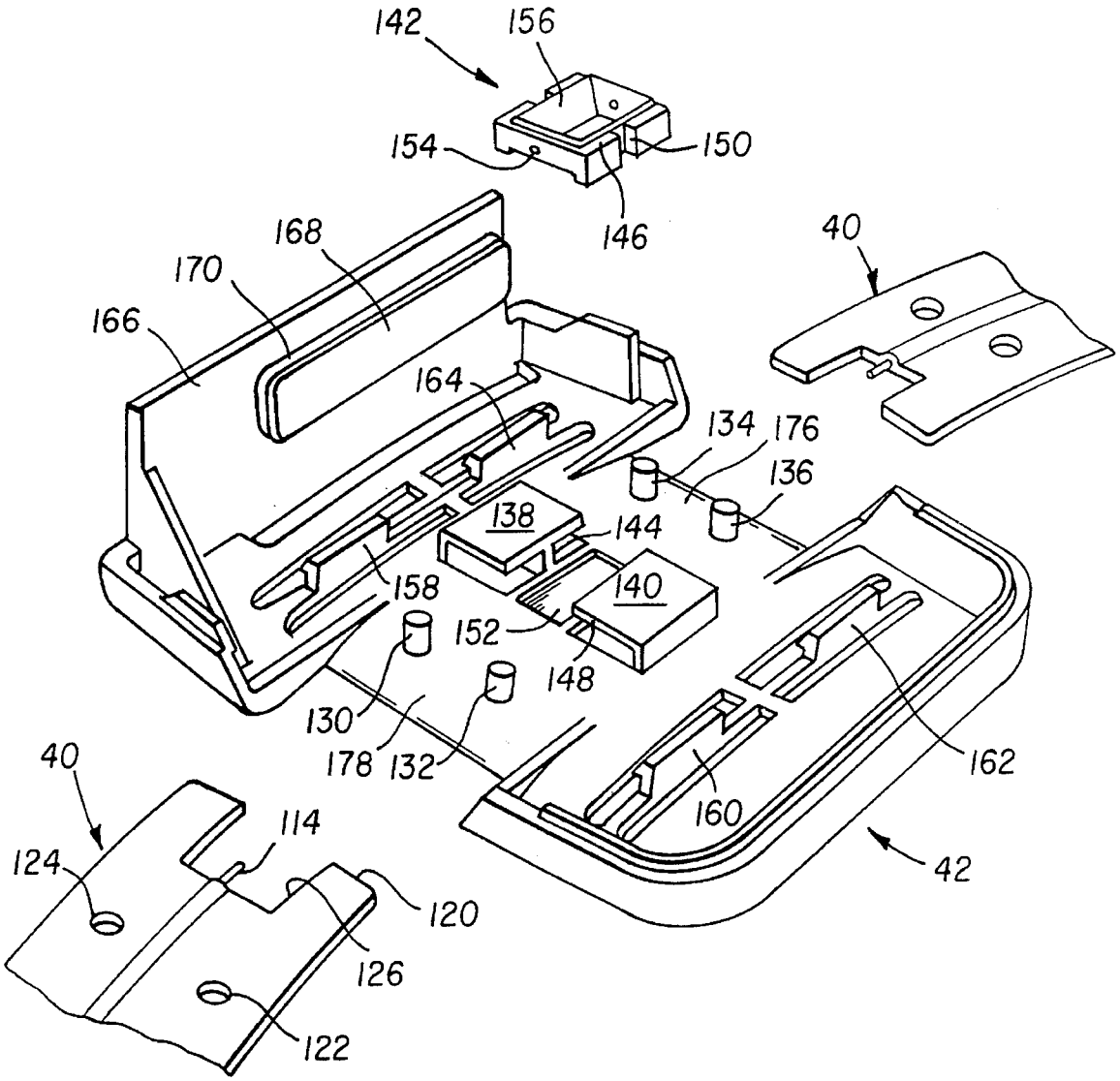
FIG. 7 is a perspective view depicting features of the buckle forming part of the transmitter assembly.

Buckle 42 is illustrated most clearly in FIG. 7, including a first side (not shown), that is smooth and slightly curved to fit comfortably against a wrist or ankle, and a second side depicted in FIG. 7. The buckle is a unitary frame that is thin and light weight including a first set of features for attaching the strap to the buckle independently of the transmitter housing, and a second set of features that receives the transmitter housing, properly locating the housing relative to the strap.

The first set of features include pins or posts 130, 132, 134, and 136, and constraints or cages 138 and 140. The pins have a diameter approximately the same as the strap holes 122 and 124. The cages locate a gasket seal 142 between the cages and receive the bifurcated ends of the strap 40 under the cages, holding the bifurcated ends down against the flat portion of the buckle and also holding the strap with holes 122 and 124 on the posts 130, 132, 134, and 136. Each cage 138 and 140 is divided by a column divider 144, separating each cage into two parts: a first part for receiving a first end of the strap and a second part for receiving the second end of the strap. The column 144 is thin, so it adds very little to the combined length of the strap and buckle when the strap is attached to the buckle. As described above, the strap is cut after measuring the length on the appendage of the individual that will wear the transmitter assembly. When the strap is attached to the buckle, the ends 120 of the strap 40 are separated by only a small amount, slightly greater than the width of column 144, and less than three eighths of an inch. Thus, the strap and buckle together define a length or circumference that is only slightly larger, not more than approximately three eighths of an inch, than the length of the strap alone. This slight increase accomodates the thickness of the buckle between the appendage and the strap.

The cages 138 and 140, and the columns 144, also capture and locate the gasket 142, with a lip 146 under ledge 148, with notch or recess 150 around column 144, and with the bottom of the gasket in a depression 152. The gasket is shaped with a width slightly smaller than the strap notch 126 so the bifurcated ends of the strap straddle the gasket. The gasket is made of a resilient material sealing the ends of the optical fiber 114, which project through holes 154 in the gasket to an interior protected compartment 156. This compartment 156 is closed when the transmitter housing is attached to the buckle, and protects the optical interfaces between the ends of the optical fiber 114, the emitter 90 and the sensor 94 from contamination.

The second set of buckle features, for receiving the transmitter housing, include latches 158, 160, 162, and 164, and the lip 112 around the outside edges of the buckle. The latches 158, 160, 162, and 164 are arranged and located to receive the corresponding latches 102, 104, 106 and 108 of the transmitter base plate 150, latching and resiliently pulling the transmitter housing 44 toward the buckle. The transmitter housing is aligned on the buckle 42 by engagement between the edges 110 of the housing 44 and the lip 112 of the buckle. Such orientation positions the emitter 90 and sensor 94 in predetermined positions inside compartment 156 of seal 142, and properly aligned relative to the ends of the optical fiber 114. Light from the emitter 90 is then coupled through the optical fiber 40 to the sensor 94.

Positioning of the transmitter housing on the buckle also closes the battery compartment 52. Face plate 166 extends perpendicular from the base of the buckle to extend over the opening 64 in the battery compartment 52. Protrusion 168 is slightly smaller than the opening, engaging the battery, while ring seal 170 seals the opening.

Skirts 172 and 174 (FIG. 2) extend over the strap 40, where the strap enters the buckle 42, assisting bending of the strap into recesses 176 and 178 (FIG. 7) in the buckle and around the appendage.

Assembly And Method

In use the transmitter assembly is supplied in three parts (not including the battery): the transmitter housing 44, the strap 40 and the buckle 42. The strap 40 is supplied in bulk on fifty or one hundred foot rolls and is cut to length for each individual. The strap is fit around the intended appendage, such as a wrist or ankle, and is cut to fit comfortably but snugly around the appendage with no overlap. The ends of the strap are then notched and punched as described above.

Figure 11:
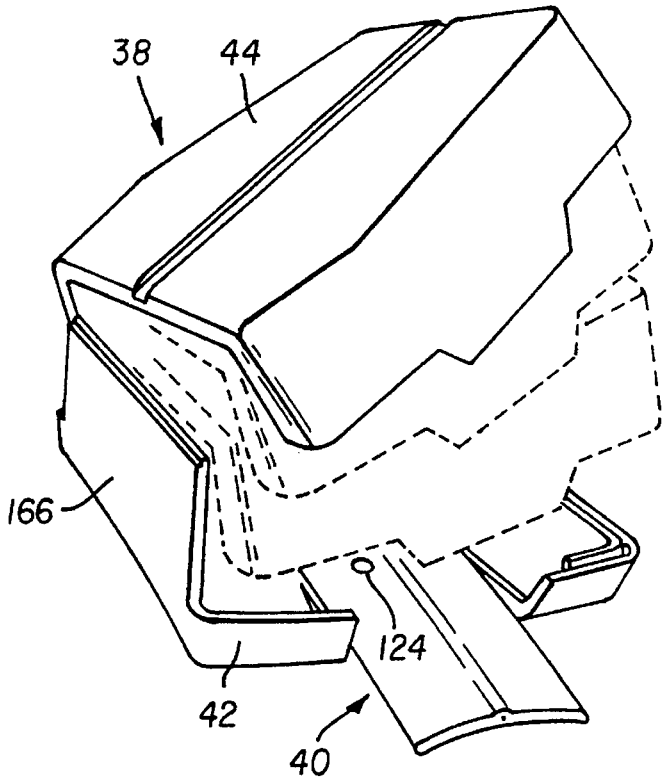
FIG. 11 is a perspective view depicting the assembly of the transmitter housing on the buckle, covering the ends of the strap.

After the strap is cut to length, it is attached around the appendage and to the buckle 42. As already described, the strap 40 and buckle 42 include features permitting their attachment to the appendage without the transmitter housing. After the strap and buckle are attached, the transmitter housing is added as depicted in FIG. 11, by engaging one one end near the battery housing and pivoting the housing into position on the buckle. The latches and cooperating features of the housing 44 and buckle 42 locate the elements supported by the transmitter housing in proper position and orientation relative to corresponding elements of the buckle 42 and strap 40. The emitter 90 and sensor 94, for example, are positioned adjacent the ends of the optical fiber 114 in compartment 156 of gasket 142. The transmitter housing covers the features that attach the strap to the housing, rendering the fasteners inaccessible to the individual wearing the transmitter assembly.

Summary and Conclusion

It should now be apparent that the buckle serves several functions. It holds the strap around an appendage of an individual, even before the transmitter housing is attached. It receives the transmitter housing, and establishes the relative positions of the strap and the housing, particularly the ends of the strap, the emitter and the sensor. It protects the emitter, the sensor and the ends of the optical fiber where it is optically coupled to the emitter and sensor. The buckle receives the transmitter housing in a manner that covers the strap fasteners, rendering the points of attachment inaccessible to the wearing individual. And it supports the optical fiber, the emitter and the sensor to form a light path from the emitter through the fiber to the sensor. This light path is broken, and triggers a tamper signal, by any of the following events: a) separation of the housing from the buckle, b) separation of the strap from the buckle, or c) severing the strap.

The invention also facilitates fitting of the transmitter assembly on an appendage of an individual first by cutting the strap to length measured on the appendage, then by attaching the strap and buckle on the appendage and finally by clipping the transmitter housing to the buckle. This method also provides for supplying the strap in and cutting the strap from a bulk roll.

While the invention is described in connection with a preferred embodiment, other modifications and applications will occur to those skilled in the art. The claims should be interpreted to fairly cover all such modifications and applications within the true spirit and scope of the invention.

PARTS LIST FOR FIGURES

| Reference No. | Part | Reference No. | Part |
|---|---|---|---|
| 10. | Transmitter assembly | 74, 76, & 78. | Walls |
| 12. | Field station | 80. | Peripheral edges |
| 14. | Monitoring center | 82. | Housing wall |
| 16. | Transmitter | 84. | Hallway |
| 18. | Amplifier | 86. | Microprocessor |
| 20. | Antenna | 88. | Tamper circuit |
| 22. | Antenna | 90. | Emitter |
| 24. | Receiver | 92. | Driver |
| 26. | Schedule | 94. | Sensor |
| 28. | Modem | 96. | Amplifier |
| 30. | Modem | 97. | Aperture |
| 32. | Phone network | 98. | Aperture |
| 34. | Computer | 100. | Separator |
| 36. | Master schedule | 102, 104, 106, & 108. | Latches |
| 38. | Housing | 110. | Edge |
| 40. | Strap | 112. | Lip |
| 42. | Buckle or clip | 114. | Optical fiber |
| 44. | Housing cover | 116, 118. | Non-stretchable fiber |
| 46. | Battery shield | 120. | Ends |
| 48. | Circuit board | 122, 124. | Holes |
| 50. | Base plate | 126. | Notch |
| 52. | Battery compartment | 128. | End of notch |
| 54, 56 & 58. | Compartment walls | 130, 132, 134 & 136. | Pins or posts |
| 59. | Peripheral edge | 138 & 140. | Cages |
| 60. | Recess | 142. | Gasket |
| 62. | Face plate | 144. | Column divider |
| 64. | Opening | 146. | Lip |
| 65. | Battery contact | 148. | Ledge |
| 66. | Battery contact | 150. | Recess or notch |
| 68. | Circuit board section | 152. | Depression |
| 70. | Peripheral edge | | |
| 72. | Recess | | |
| 154. | Holes | | |
| 156. | Interior compartment | | |
| 158, 160, 162 & 164. | Latches | | |
| 166. | Face plate | | |
| 168. | Protrusion | | |
| 170. | Ring seal | | |
| 172 & 174. | Skirts | | |
| 176 and 178. | Recesses | | |

What is claimed is:

1. An assembly wearable by an individual, said assembly including a housing containing a transmitter, a strap and a buckle for attaching the transmitter housing to the individual; characterized in that:

said buckle includes fasteners for holding the strap and buckle together on an appendage of the individual independent of said transmitter housing, and latches for attaching said transmitter housing to said buckle.

2. The invention of claim 1, wherein said transmitter housing covers said fasteners rendering said fasteners inaccessible to the individual.

3. The invention of claim 1, wherein said strap is continuous from a first end to a second end, and said fasteners hold the strap to said buckle with said ends in close proximity to each other.

4. The invention of claim 1, wherein said strap includes an embedded optical fiber having first and second fiber ends, and said fasteners hold said first and second fiber ends to said buckle aligned in a common plane.

5. The invention of claim 1, wherein said strap includes an embedded optical fiber having first and second fiber ends, said fasteners hold said first and second fiber ends to said buckle in predetermined positions relative to said buckle, said transmitter housing supports a light emitter and a light sensor, and said latches secure the housing to said buckle with said emitter adjacent said first fiber end and said sensor adjacent said second fiber end.

6. The invention of claim 5, wherein said fasteners hold the optical fiber on said buckle with the first and second fiber ends aligned in a common plane, said emitter and sensor are adjacent one another in back to back relationship projecting through an aperture in said housing, and said latches secure said housing to said buckle with said emitter and sensor in optical alignment between said first and second fiber ends.

7. The invention of claim 1, wherein said housing includes a tamper detection circuit including a light emitter and a light sensor supported by said housing, said strap includes an imbedded optical fiber, and said buckle supports said optical fiber, said emitter and said sensor to form a light path from said emitter through said fiber to said sensor, whereby said light path is broken by: a) separation of said housing from said buckle, b) separation of said strap from said buckle, or c) severing said strap including said optical fiber.

8. The invention of claim 1, wherein said strap defines first and second notched ends, said strap includes an embedded optical fiber projecting out of said strap into said notches, and said fasteners hold said fiber ends in predetermined positions relative to said buckle.

9. A transmitter assembly wearable by an individual and comprising:

a housing containing a transmitter, a compartment for receiving a battery, and a tamper detection circuit including a light emitter and a light sensor;

a strap including an embedded optical fiber; and, a buckle for assembling the strap and the transmitter in order, said strap first around an appendage of the individual holding said buckle on said appendage, and thereafter said transmitter housing on said buckle with said fiber coupled optically between said emitter and said sensor.

10. The invention of claim 9, wherein said optical fiber has first and second ends, said buckle holds the optical fiber on said buckle with the first and second fiber ends aligned facing each other in a common plane, said emitter and sensor are adjacent one another in back to back relationship projecting through an aperture in said housing, and said buckle secures said housing on said buckle with said emitter and sensor in optical alignment between said first and second fiber ends.

11. The invention of claim 10, wherein said optical coupling is broken by: a) separation of said housing from said buckle, b) separation of said strap from said buckle, or c) severing said optical fiber.

12. The invention of claim 9, wherein said buckle includes fasteners for holding said strap on said buckle, and said transmitter housing is configured to cover said fasteners when said housing is secured to said buckle, rendering said fasteners inaccessible to the individual wearing the assembly.

13. A wearable clip for attaching a transmitter to a body appendage with an elongate strap; said clip comprising:

a thin frame defining a first smooth side adapted to engage said appendage and a second opposite side, said second side including features for releasable attaching said strap around the appendage to said clip, said second side further including means for receiving the transmitter on said frame with said transmitter capturing said strap against said frame, preventing release of said strap from said frame.

14. The invention of claim 13, wherein said strap includes first and second ends, said attaching features align said first and second ends in predetermined positions on said frame, and said transmitter receiving means locates said transmitter on said frame over said first and second ends.

15. The invention of claim 14, wherein said transmitter includes a tamper detecting circuit including a light emitter and a light sensor, said strap includes an optical fiber, and said transmitter receiving means locates said transmitter on said frame with said fiber optically coupling said emitter to said sensor.

16. The invention of claim 15, wherein said frame supports a flexible seal defining an inside region and an outside region, said strap attaching features align the strap adjacent said seal in the outside region with the optical fiber extending through the seal to the inside region, and the transmitter receiving means locates the emitter and sensor adjacent the optical fiber in the inside region.

17. A method of attaching a wearable transmitter to a body appendage; said method comprising the following steps in the order listed:

encircling said appendage with a strap and cutting said strap to a length snugly fitting around the appendage with no overlap between the ends of the strap;

attaching said strap around said appendage with a buckle that locates the ends of the strap adjacent one another, with said buckle and strap fitting snugly around said appendage; and attaching said transmitter to said buckle.

18. The invention of claim 17, wherein said strap is supplied in a bulk roll and said cutting is from said bulk roll.

19. A flexible band for securing a portable transmitter to an appendage of an individual; said band comprising:

an elongate strip of thermoplastic material defining a thin cross section and extending as a single piece from a first end of said strip to a second end of said strip;

said strip including embedded strands running lengthwise through the strip, one of said strands being thermally inelastic and another of said strands being an optical fiber extending through said strip from said first end to said second end.

20. A flexible band for securing a portable transmitter to an appendage of an individual; said band comprising:

an elongate strip of thermoplastic material defining a thin cross section and extending as a single piece from a first end of said strip to a second end of said strip, said first and second ends respectively defining a central notch between bifurcated extensions of said strip;

said strip including embedded strands running lengthwise through the strip, one of said strands being thermally inelastic and another of said strands being an optical fiber extending through said strip and into said notches between said bifurcated extensions at said first and second ends, respectively.

21. The invention of claim 20, wherein the transmitter includes fastening pins, and said first and second ends respectively define holes passing entirely through said strip for receiving said pins.

22. The invention of claim 20, wherein said strands include three strands, two thermally inelastic strands on opposite sides of said optical strand, respectively.

23. The invention of claim 20, wherein said strip is less than a quarter of an inch thick and between a half of an inch and two inches wide.

24. An assembly wearable on an appendage of an individual and comprising:

a housing defining a closed transmitter compartment and a battery compartment open at one end for receiving a battery through said end; and, a buckle for attaching said transmitter housing to the appendage, said buckle including a face plate and sealing surfaces on said face plate for closing said open end, said face plate further including latching elements for attaching said housing to said buckle with said sealing surfaces engaging said housing around said opening.

25. A transmitter assembly wearable by an individual and comprising:

a housing containing a transmitter, an open compartment for receiving a battery, and a tamper detection circuit including a light emitter and a light sensor;

a strap including an embedded optical fiber; and, a buckle for assembling the strap and the transmitter in order, said strap first around an appendage of the individual holding said buckle on said appendage, and thereafter said transmitter housing with said fiber coupled optically between said emitter and said sensor, and with said buckle covering said opening of said battery compartment.

* * * * *